US008443790B2

(12) United States Patent
Pestrue

(10) Patent No.: US 8,443,790 B2
(45) Date of Patent: May 21, 2013

(54) COCKING WINCH APPARATUS FOR A CROSSBOW, CROSSBOW SYSTEM INCLUDING THE COCKING WINCH APPARATUS, AND METHOD OF USING SAME

(75) Inventor: Jeffrey A. Pestrue, St. Louis, MI (US)

(73) Assignee: Eastman Outdoors, Inc., Flushing, MI (US)

( * ) Notice: Subject to any disclaimer, the term of this patent is extended or adjusted under 35 U.S.C. 154(b) by 776 days.

(21) Appl. No.: 12/118,411

(22) Filed: May 9, 2008

(65) Prior Publication Data

US 2009/0277435 A1 Nov. 12, 2009

(51) Int. Cl.
*F41B 5/12* (2006.01)

(52) U.S. Cl.
USPC ..... 124/25

(58) Field of Classification Search
USPC ..... 124/25
See application file for complete search history.

(56) References Cited

U.S. PATENT DOCUMENTS

| | | | |
|---|---|---|---|
| 3,670,711 | A | 6/1972 | Firestone |
| 5,115,795 | A | 5/1992 | Farris |
| 5,220,906 | A | 6/1993 | Choma |
| 6,095,128 | A | 8/2000 | Bednar |
| 6,286,496 | B1 | 9/2001 | Bednar |
| 6,705,304 | B1 | 3/2004 | Pauluhn |
| 6,874,491 | B2 | 4/2005 | Bednar |
| 6,913,007 | B2 | 7/2005 | Bednar |
| 7,100,590 | B2 | 9/2006 | Chang |
| 7,363,921 | B2 | 4/2008 | Kempf |

*Primary Examiner* — John Ricci
(74) *Attorney, Agent, or Firm* — Clark Hill PLC

(57) ABSTRACT

A crossbow having a bowstring cocking winch apparatus, a cocking winch apparatus usable with a crossbow, and a method of operating the apparatus are described. The cocking winch apparatus includes a projecting alignment member having a non-round cross-sectional shape, where the alignment member is removably securable to a butt portion of a crossbow stock by inserting the alignment member into a correspondingly-shaped hole formed in the stock. The cocking winch apparatus provides a straight and balanced draw to the crossbow bowstring, enabling a user to easily cock the bowstring by rotating a handle to draw the bowstring back, and to place it in cocked position in the crossbow trigger mechanism.

10 Claims, 15 Drawing Sheets

COCKING WINCH APPARATUS FOR A CROSSBOW, CROSSBOW SYSTEM INCLUDING THE COCKING WINCH APPARATUS, AND METHOD OF USING SAME

BACKGROUND OF THE INVENTION

1. Field of the Invention

The present invention relates to the field of archery, specifically crossbows. More particularly, the present invention relates to an improved cocking winch apparatus for use in arming a crossbow, to a crossbow system including the cocking winch apparatus, and to a method of using the cocking winch apparatus to prepare a crossbow for firing a projectile.

2. Description of the Background Art

Crossbows in general have a very large drawing force, making them difficult to cock without the use of force-multiplying tools. A number of different cocking devices are known for use with crossbows. Examples of some of the known cocking devices include those described in U.S. Pat. Nos. 5,220,906, 6,095,128, 6,286,496, 6,874,491, 6,913,007, 7,100,590 and 7,363,921.

Although the known crossbow cocking devices have some utility for their intended purposes, a need still exists in the art for an improved crossbow cocking winch apparatus. In particular, there is a need for a crossbow cocking winch apparatus which will overcome the difficulties encountered with the known art, such as being easily and securely attached to a crossbow such that it can be quickly removed for repair, replacement, transportation or storage, and including improved structure for easily aligning a main winch body with the crossbow.

SUMMARY OF THE INVENTION

The present invention provides an improved cocking winch apparatus for attaching to a crossbow, and for use in cocking the crossbow. The apparatus according to the invention can be removably mounted to a corresponding crossbow stock in an aligned configuration, and can be used to draw back the main bowstring and temporarily lock it in place in a latching mechanism of the crossbow. Once the bowstring has been locked in place in the latching mechanism, the cocking winch can be removed to de-clutter the crossbow and to make the crossbow easier to aim and fire.

In one illustrative embodiment of the invention, the cocking winch apparatus includes a winch assembly with a winch body having an upper portion with a ratcheting mechanism therein, an intermediate connecting portion, and a lower portion including an alignment member projecting forwardly below the upper portion and having a non-round cross-sectional shape. The alignment member may be tapered so as to be smaller at an outer front end thereof, and larger at an inner rear end thereof, where it contacts the intermediate connecting portion of the winch body.

The winch body is removably securable to a matching crossbow stock, which is configured to work with the winch apparatus, by aligning the winch body with the stock and inserting the alignment member into a correspondingly-shaped hole formed in the stock. The hole in the stock is situated so that when the alignment member is installed in the stock, the upper portion of the winch body abuttingly contacts and rests on top of the stock.

Also in this embodiment, the winch assembly includes a cylindrical support shaft extending through a cylindrical passage formed in the winch body, along with first and second take-up spools, mounted on opposed end portions of the support shaft outside of the winch body, and the ratcheting mechanism includes a ratchet wheel mounted on the support shaft between the first and second take-up spools. The ratchet wheel is disposed in the hollow chamber of the winch body and has a plurality of teeth formed around an outer circumference thereof.

The ratcheting mechanism also includes a pawl having a first end disposed in the hollow chamber of the winch body and pivotally attached to the winch body, and a second end opposite the first end, and a spring for biasing the pawl towards the ratchet wheel. The pawl has a tooth formed thereon for selective engagement between adjacent teeth of the ratchet wheel.

The cocking winch apparatus also includes a handle member operatively attachable to one of the take-up spools, and a tensioning cable having a first end attached to the first take-up spool, a second end attached to the second take-up spool, and a central portion disposed between the first and second ends.

The cocking winch apparatus according to the first embodiment further includes a bowstring hook having a slot formed in a lower portion thereof to receive the bowstring, wherein the central portion of the tensioning cable passes through a portion of the bowstring hook.

Optionally, the bowstring hook may include a bowstring guide assembly with a frame, a pair of front pulleys and a pair of rear pulleys. The front and rear pulleys are rotatably attached to the frame, and the central portion of the tensioning cable passes around the rear pulleys of the bowstring guide assembly.

A second embodiment of the present invention provides a crossbow system including both a crossbow and a cocking winch apparatus operatively attachable to the crossbow.

The crossbow includes a stock having a front end and a rear end with a longitudinal axis extending therebetween, where the front end defines a shooting direction. The front end of the stock includes a main beam having a horizontal slot formed therein, and the rear end of the stock has a shaped hole formed therein having a non-round shape, and a channel extending from the shaped hole inwardly into the stock.

The crossbow also includes a bow section including a central riser, a first limb and a second limb, where the riser is attached to the front end of the stick and the first and second limbs are operatively attached to the riser, in a manner in which the first limb and the second limb extend outwardly away from one another in substantially opposite directions.

The crossbow also includes a main bowstring extending between the outer ends of the limbs, for drawing back to arm the crossbow, and for use in launching specialized arrows generally referred to as crossbolts.

As noted above, the crossbow system according to the second embodiment of the invention also includes cocking winch apparatus. This apparatus is the apparatus as previously described herein, including a winch body, a cylindrical support shaft extending through the cylindrical passage of the winch body, first and second take-up spools mounted on opposed end portions of the support shaft, a ratchet wheel mounted on the support shaft, a pawl having a tooth for selectively engaging between teeth of the ratchet wheel, a handle member, a tensioning cable having first and second ends attached to the respective take-up spools, and a bowstring hook member having a slot formed in a lower portion thereof to receive the bowstring.

A third embodiment of the present invention provides a method of cocking a crossbow using the inventive winch cocking apparatus described above. One example of a method according to the invention includes a first step of engaging the cocking winch apparatus with a crossbow stock by aligning a winch body with the crossbow stock, and inserting an alignment member of the winch body into a shaped opening formed in the crossbow stock configured to accept the alignment member therein.

In the next step of the exemplary method, the user engages a bowstring hook member of the cocking apparatus with a bowstring of the crossbow, with the bowstring in a released position thereof.

In the next step of the exemplary method, the user operates the cocking winch apparatus to draw the bowstring hook member and the engaged bowstring rearwardly towards a bowstring latch mechanism. Then, the user engages the bowstring with the bowstring latch mechanism.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION

It should be understood that only structures considered necessary for clarifying the present invention are described herein. Other conventional structures, and those of ancillary and auxiliary components of the system, are assumed to be known and understood by those skilled in the crossbow art.

Figure 1A:
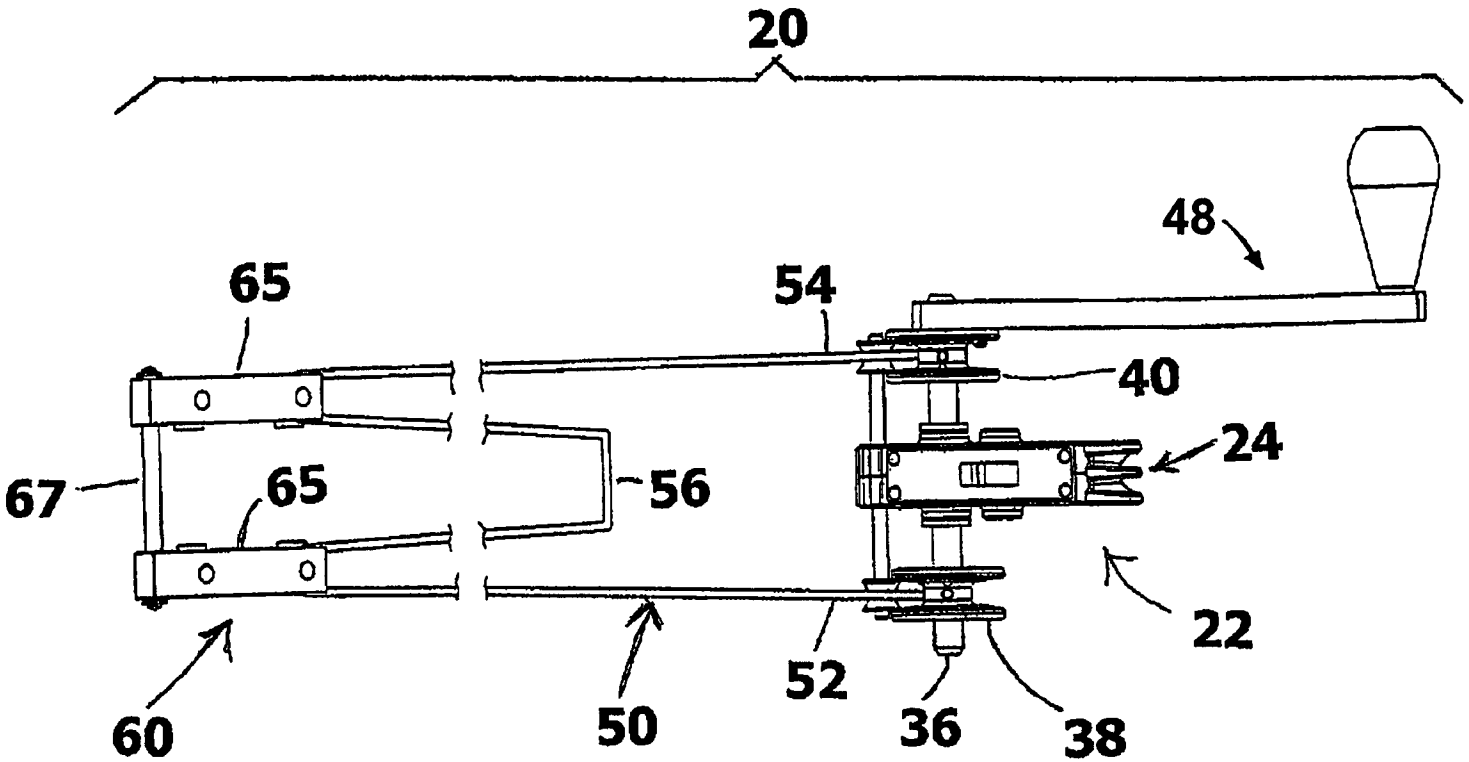
FIG. 1A is a top plan view of a cocking winch mechanism according to a selected illustrative embodiment of the present invention.
Figure 1B:
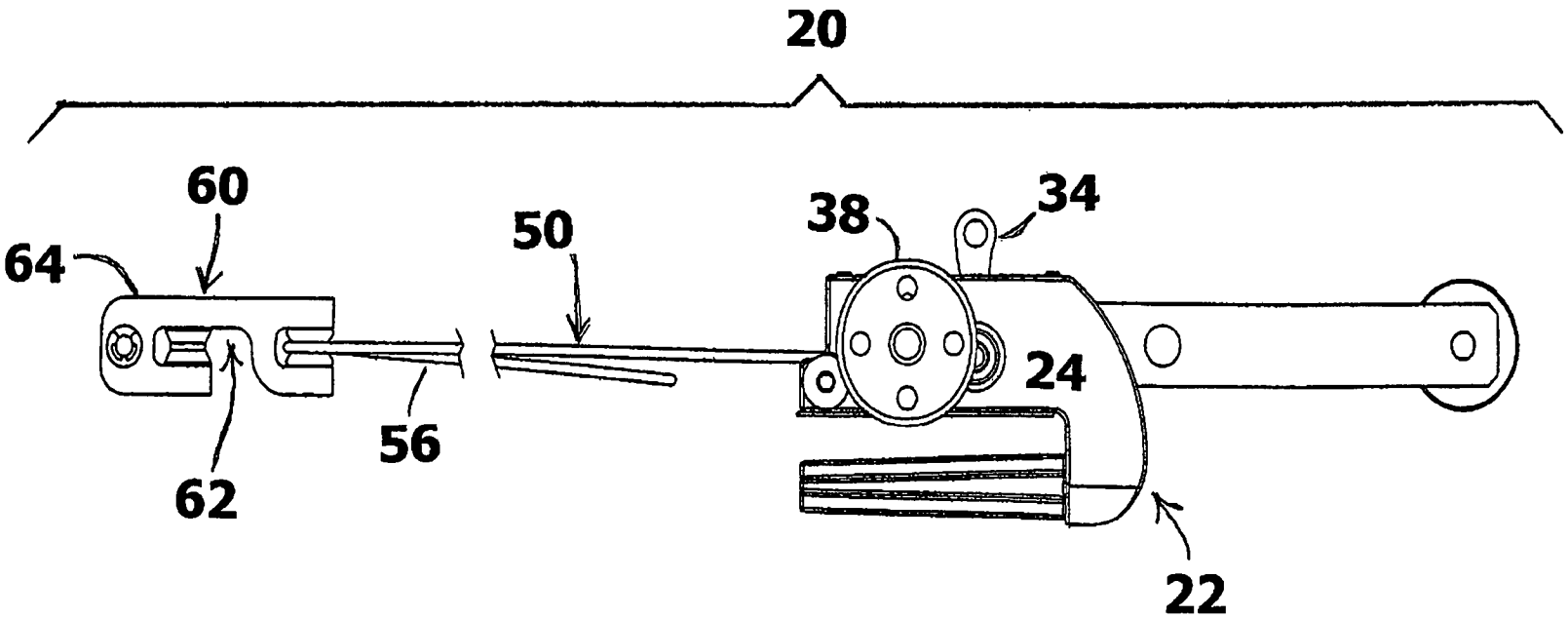
FIG. 1B is a side plan view of the cocking winch mechanism of FIG. 1A.
Figure 1C:
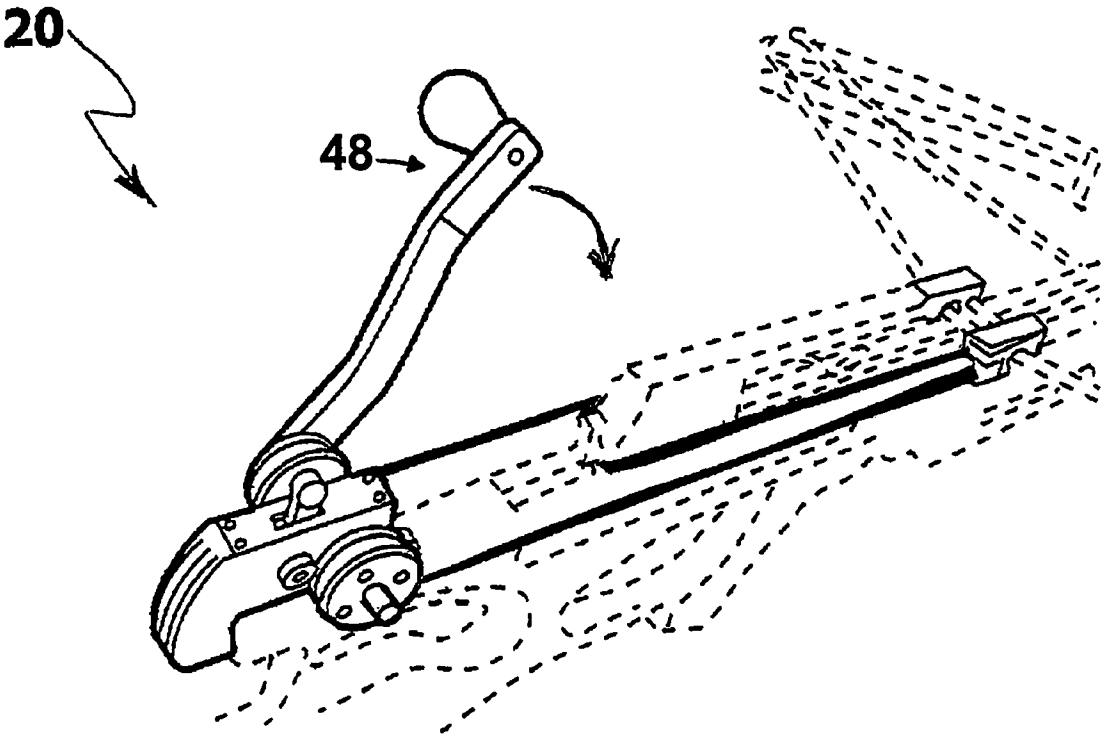
FIG. 1C is a perspective view of the cocking winch mechanism of FIGS. 1A-1B, with a portion of a crossbow shown in phantom.
Figure 2:
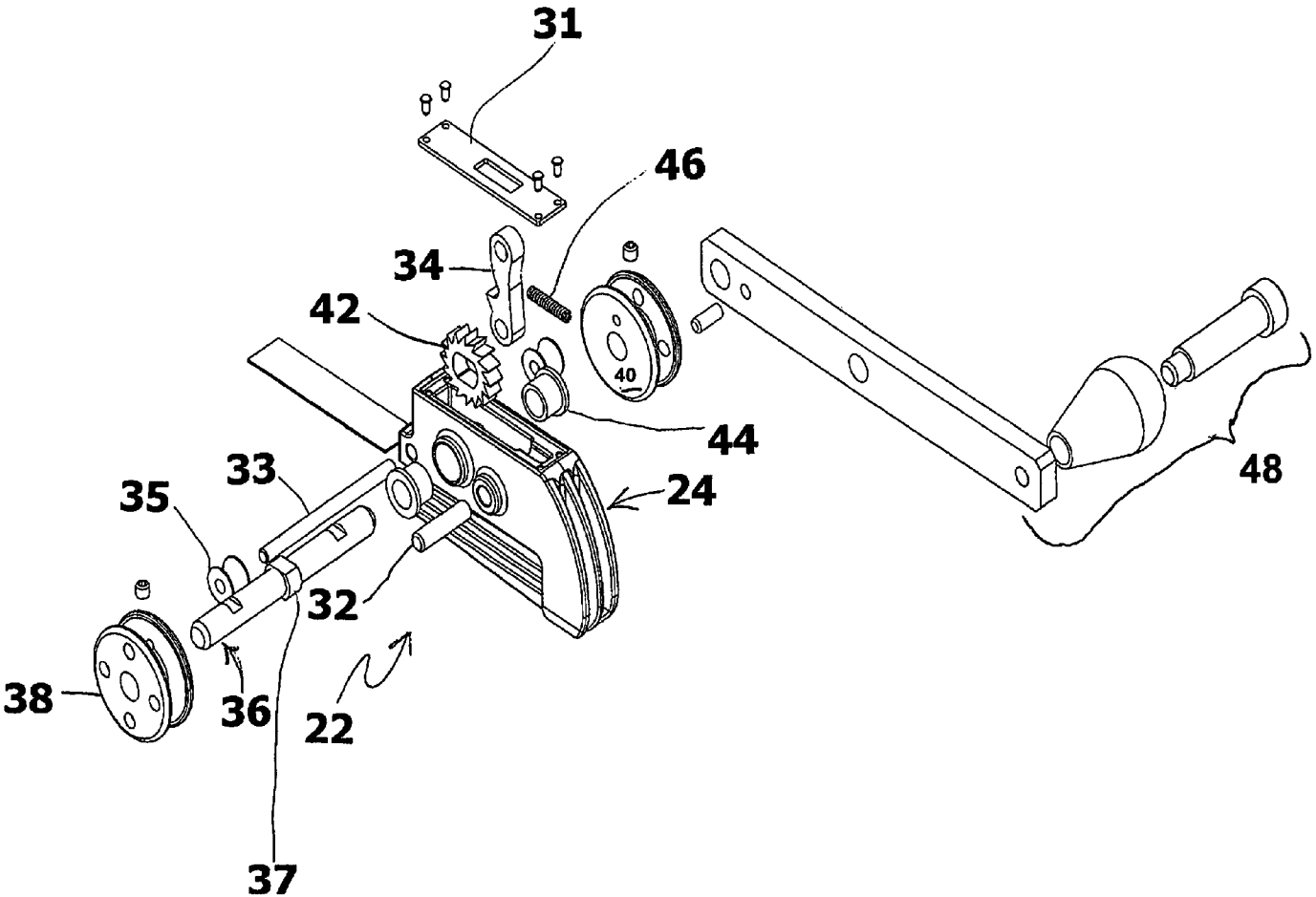
FIG. 2 is an exploded perspective view of a winch assembly, which is a component of the cocking winch mechanism of FIGS. 1A-1B.
Figure 3:
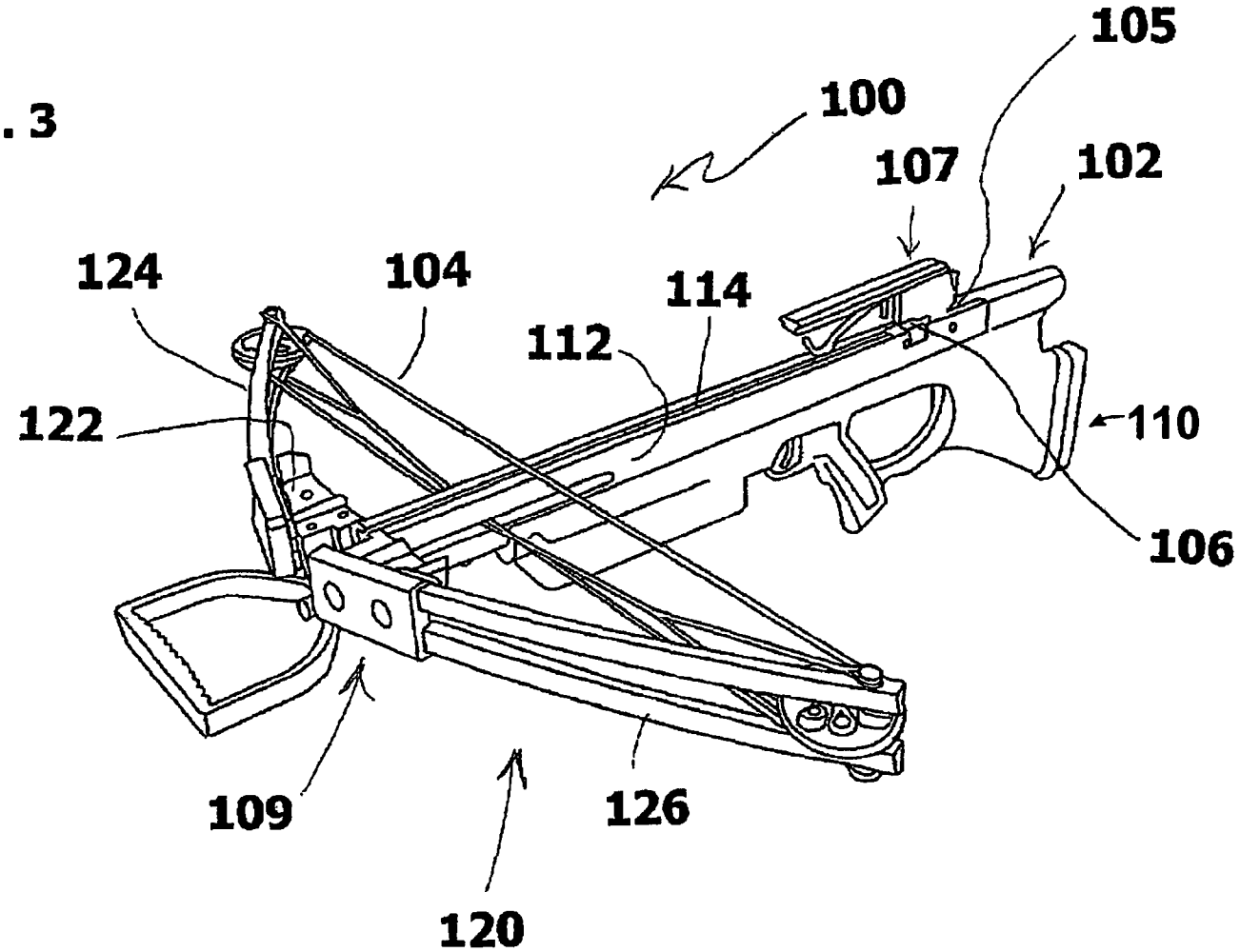
FIG. 3 is a perspective view of a crossbow, which the cocking winch mechanism of FIGS. 1-2 may be used to operate.
Figure 4A:
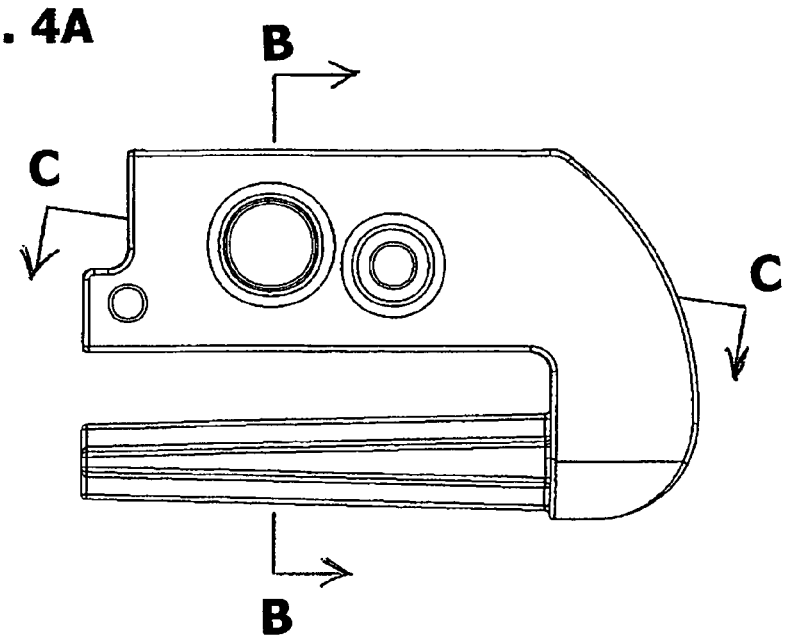
FIG. 4A is a side plan view of a winch body, which is a component of the cocking winch mechanism of FIGS. 1-2.
Figure 4B:
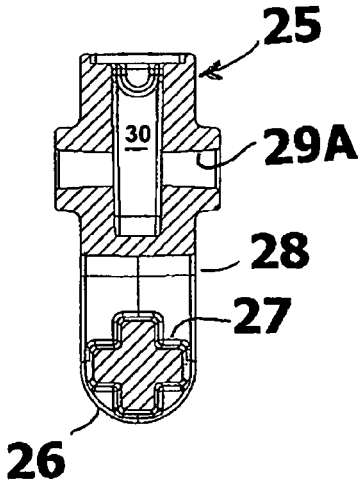
FIG. 4B is a cross-sectional view of the winch body of FIG. 4A, taken along the line B-B thereof.
Figure 4C:
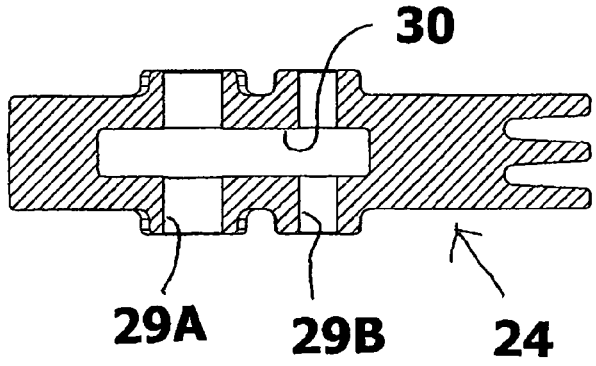
FIG. 4C is a cross-sectional view of the winch body of FIG. 4A, taken along the line C-C thereof.
Figure 4E:
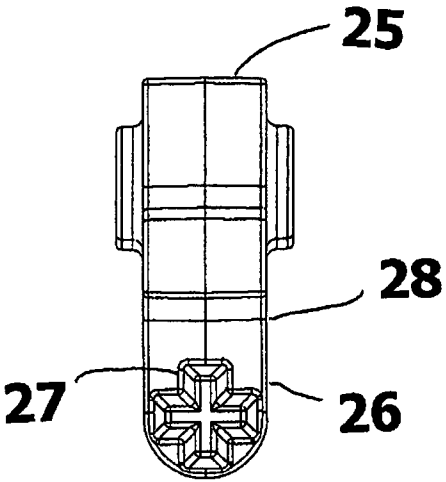
FIG. 4E is a front plan view of the winch body of FIG. 4A.
Figure 4D:
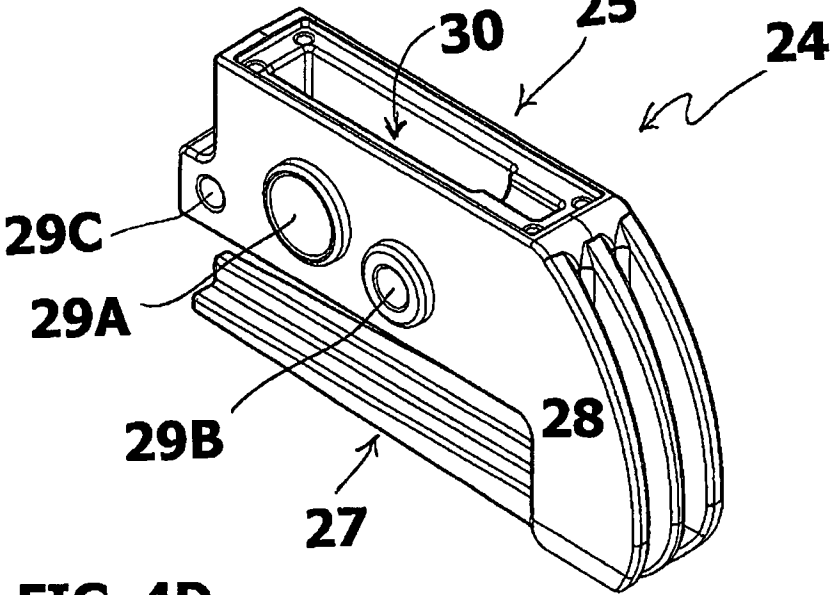
FIG. 4D is a perspective view of the winch body of FIG. 4A.
Figure 5:
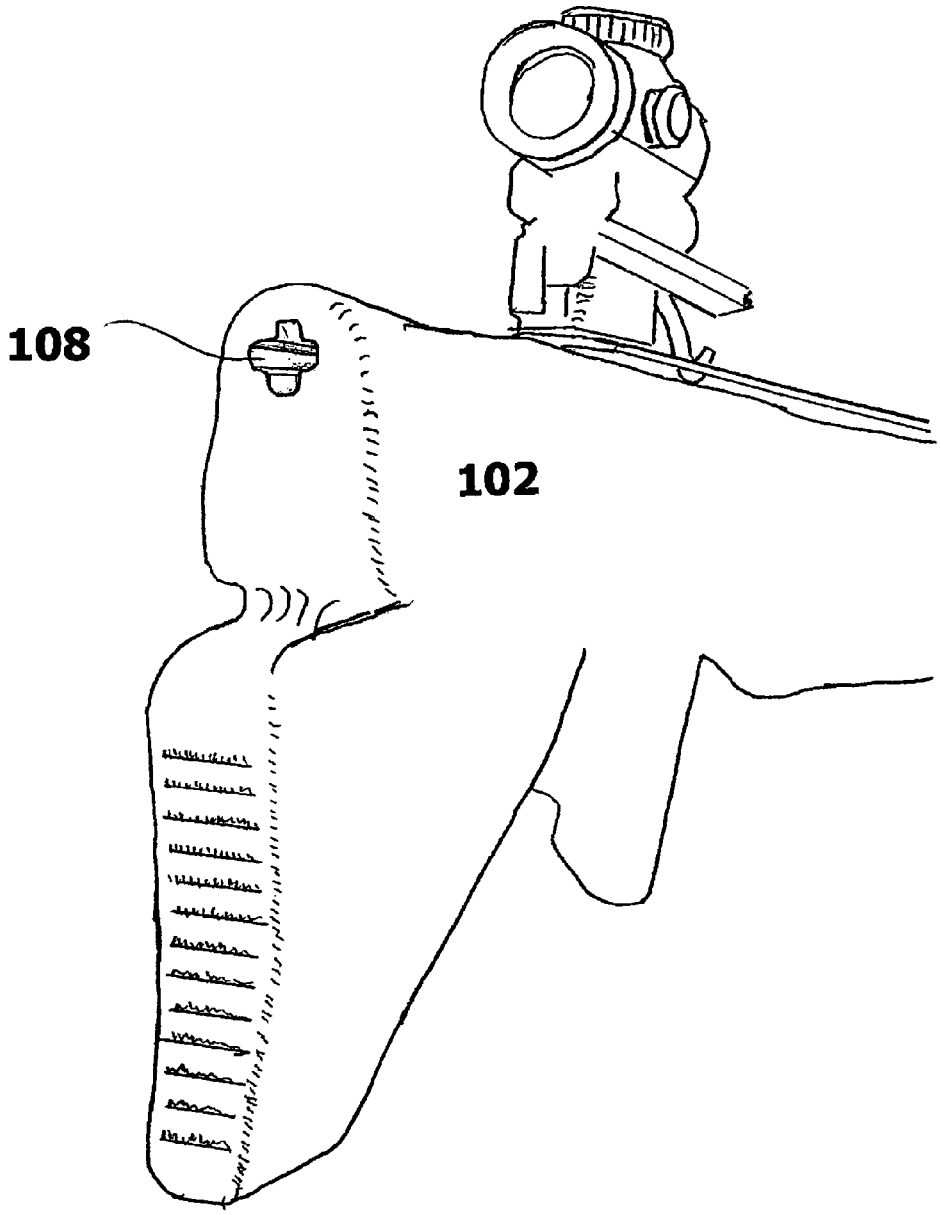
FIG. 5 is a partial perspective end view of the crossbow of FIG. 4.

Referring now to FIGS. 1-3 of the drawings, an improved cocking winch apparatus 20 is shown generally in FIGS. 1 and 2. The cocking winch apparatus 20 (also referred to herein as the cocking winch 20) is provided for attaching to a crossbow 100 (FIG. 3), and for use in cocking the crossbow.

The cocking winch apparatus 20 can be removably mounted to a corresponding crossbow stock 102 in an aligned configuration, and can be used to draw back the crossbow's main bowstring 104 and temporarily lock it in place in a latching mechanism 106 of the crossbow. Once the bowstring 104 has been locked in place in the latching mechanism 106, the cocking winch 20 can be easily removed from the crossbow 100, to de-clutter the crossbow and to make the crossbow easier to fire.

In the illustrated embodiment of the invention, the cocking winch apparatus 20 includes a winch assembly 22 with a winch body 24 having an upper portion 25, a lower portion 26, and an intermediate portion 28 interconnecting the top and lower portions.

The upper portion 25 of the winch body 24 is formed in a generally rectangular hollow box shape, with left, right, front, rear, top and bottom side surfaces. The upper portion 25 of the winch body 24 has a first hollow cylindrical bore 29A formed laterally therethrough between the left and right sides thereof, and also has a hollow chamber 30 formed therein, extending downwardly from the top surface of the winch body. The hollow chamber 30 is provided to house a ratcheting mechanism (described later), and a cover plate 31 is provided to cap off the chamber of the winch body 24. Optionally, the upper portion 25 may also have a second hollow cylindrical bore 29B formed therethrough to receive a pivot pin 32, used for pivotally supporting a pawl 34 of the ratcheting mechanism. Similarly, in the depicted embodiment, a third hollow cylindrical bore 29C is formed laterally through the upper portion 25 of the winch body 24 to support a mounting pin 33 provided to support a pair of identical cable guide pulleys 35 on opposite outer ends thereof.

The lower portion 26 of the winch body 24 includes an alignment member 27 projecting forwardly below the upper portion 25, and having a non-round cross-sectional shape. In the depicted embodiment, the alignment member 27 has a cross-section formed in the general shape of a cross having four equal-length arms. The alignment member 27 may be tapered so as to be smaller at an outer forward end thereof, as shown, and larger at an inner end thereof where it contacts the intermediate portion 28 of the winch body 24.

Referring now to FIGS. 3-6, it will be seen that the winch body 24 is removably securable to a matching crossbow stock 102, which is configured to work with the winch apparatus 20 by aligning the winch body 24 with the stock 102, and then inserting the alignment member 27 into a correspondingly-shaped hole 108 formed in the rear end 110 of the stock 102. The hole 108 is situated and arranged in the stock so that when the alignment member 27 is fully installed in the stock 102, the lower surface of the winch body's upper portion 25 rests on top of, and abuttingly contacts the upper surface of the crossbow stock 102.

Also in this embodiment, the cocking winch assembly 20 includes a cylindrical support shaft 36, extending through the first cylindrical passage 29A formed in the winch body 24, and having an enlarged boss 37 formed thereon, with opposed flat edge portions, for supporting a ratchet wheel 42 thereon. A pair of bushings 44 may be used on opposite sides of the winch body 24, to rotatably support the support shaft 36 therein.

The winch assembly 20 also includes first and second take-up spools 38, 40 mounted on opposed end portions of the support shaft 36 outside of the winch body 24. It will therefore be understood that the ratchet wheel 42 is mounted on the support shaft 36 between the first and second take-up spools 38, 40, and each of these components is fixedly attached to the support shaft for concurrent rotation therewith. The ratchet wheel 42 is disposed in the hollow chamber 30 of the winch body 24, and has a plurality of teeth formed around an outer circumference thereof, as shown.

The ratcheting mechanism also includes a pawl 34, having a first end disposed in the hollow chamber of the winch body and pivotally attached to the winch body, and a second end opposite the first end. The ratcheting mechanism also includes a spring 46 for biasing the pawl towards the ratchet wheel. The pawl 34 has a tooth 34T formed thereon for selective engagement between adjacent teeth of the ratchet wheel.

The cocking winch apparatus 20 also includes a removable handle member 48 which is operatively attachable to one of the take-up spools 38, 40, and a tensioning cable 50 (FIG. 1) having a first end 52 attached to the first take-up spool 38, a second end 54 attached to the second take-up spool 40, and a central portion 56 disposed between the first and second ends 52, 54.

The cocking winch apparatus according to the first embodiment further includes a bowstring hook member 60 (FIG. 2) having a slot 62 formed in a lower portion thereof to receive the bowstring 104, wherein the central portion 56 of the tensioning cable passes through an opening 63 formed in a portion of the bowstring hook member.

Optionally, the bowstring hook member 60 may comprise a bowstring guide assembly with a frame 64, a pair of front pulleys 66 and a pair of rear pulleys 68. In the depicted embodiment, the frame 64 includes a pair of identical side portions 65 interconnected by a connecting rod 67. The front and rear pulleys 66, 68 are rotatably attached to the frame, and the central portion of the tensioning cable passes around the rear pulleys of the bowstring guide assembly.

A second embodiment of the present invention provides a crossbow system, including both a crossbow 100 and a cocking winch apparatus 20 which is operatively attachable to the crossbow.

The crossbow 100 includes a stock 102 having a front end 109 and a rear end 110 with a longitudinal axis extending therebetween, where the front end defines a shooting direction. The front end 109 of the stock 102 includes a main beam 112 having a horizontal slot 114 formed therein, and the rear end 110 of the stock has a shaped hole 108 formed therein having a non-round shape, and a channel extending from the shaped hole inwardly into the stock.

The crossbow also includes a bow section 120 including a central riser 122, a first limb 124 and a second limb 126, where the riser is attached to the front end 109 of the stock 102 and the first and second limbs 124, 126 are operatively attached to the riser 122, in a manner in which the first limb and the second limb extend outwardly away from one another in substantially opposite directions.

The crossbow 100 also includes a main bowstring 104 extending between the outer ends of the limbs 124, 126, for drawing back to arm the crossbow, and for use in launching specialized arrows generally referred to as crossbolts.

As noted above, the crossbow system according to the second embodiment of the invention also includes a cocking winch apparatus 20. This apparatus is the apparatus 20 as previously described herein, including a winch body 24, a cylindrical support shaft 36 extending through the cylindrical passage 29A of the winch body, first and second take-up spools 38, 40 mounted on opposed end portions of the support shaft 36, a ratchet wheel 42 mounted on the support shaft, a pawl 34 having a tooth 34T for selectively engaging between teeth of the ratchet wheel 42, a handle member 48, a tensioning cable 50 having first and second ends 52, 54 attached to the respective take-up spools 36, 40, and a bowstring hook member 60 having a slot 62 formed in a lower portion thereof to receive the bowstring 104.

Figure 6:
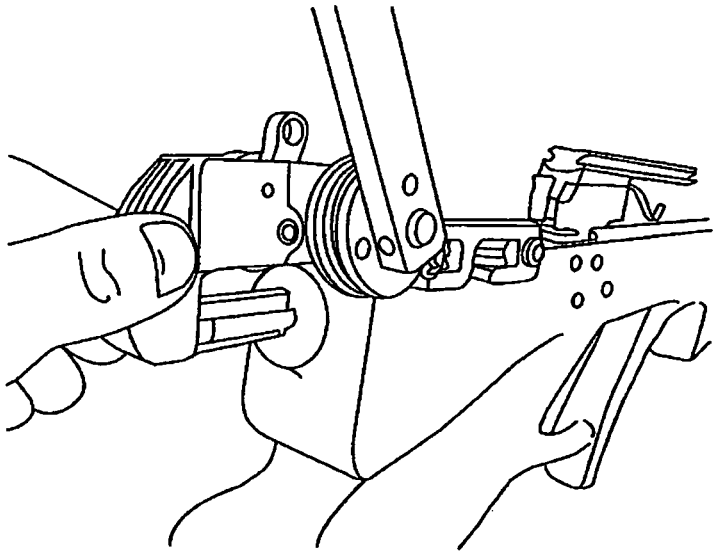
FIG. 6 is a view similar to FIG. 5, also showing the cocking winch mechanism being aligned with an opening in the crossbow stock.
Figure 7:
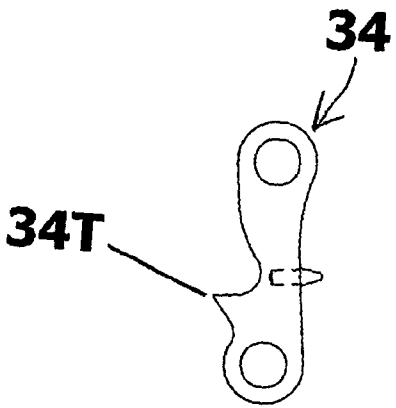
FIG. 7 is a side plan detail view showing a pawl which is one component of the winch assembly of FIG. 2.
Figure 8:
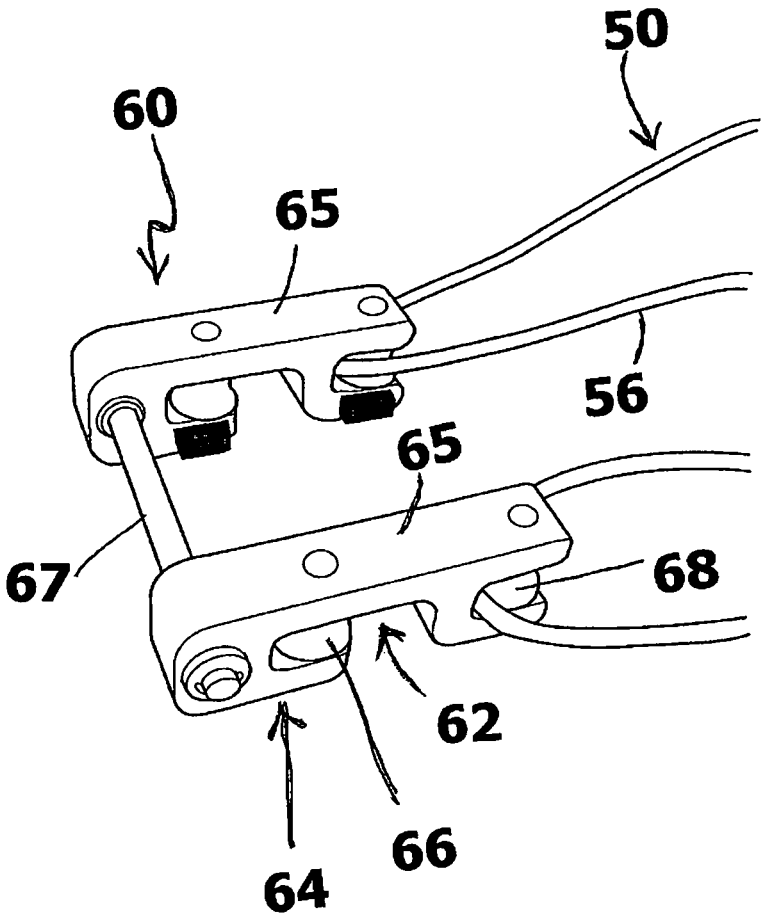
FIG. 8 is a detail perspective view of a hook member and part of a tensioning cable, where these parts are components of the apparatus of FIGS. 1A-1C.
Figure 9A:
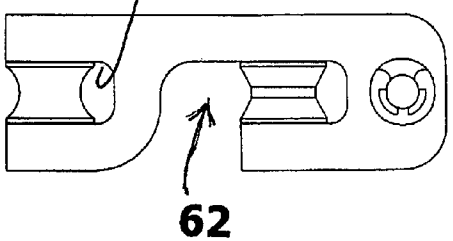
FIG. 9A is a side plan view of the hook member of FIG. 9.
Figure 9C:
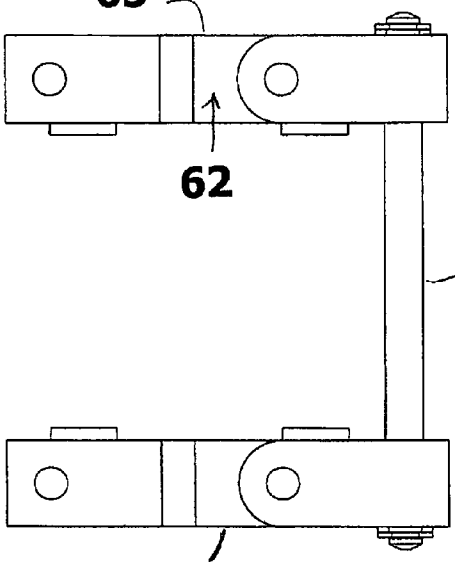
FIG. 9C is a bottom plan view of the hook member.
Figure 9B:
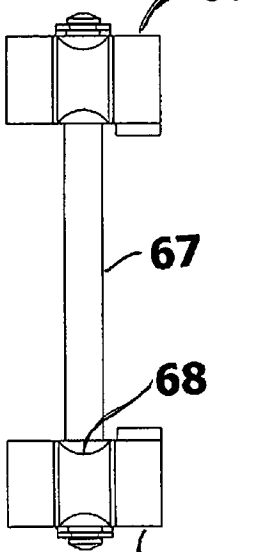
FIG. 9B is a rear plan view of the hook member.

A third embodiment of the present invention provides a method of cocking a crossbow 100, using the inventive winch cocking apparatus 20 described above. One example of a method according to the invention includes a first step of engaging the cocking winch apparatus 20 with a crossbow stock 102 by aligning a winch body 24 with the crossbow stock, and inserting an alignment member 27 of the winch body into a shaped opening 108 formed in the crossbow stock, where the shaped opening is configured to accept the alignment member 27 therein. This engaging step is illustrated by FIGS. 3 and 6 of the drawings.

Figure 10:
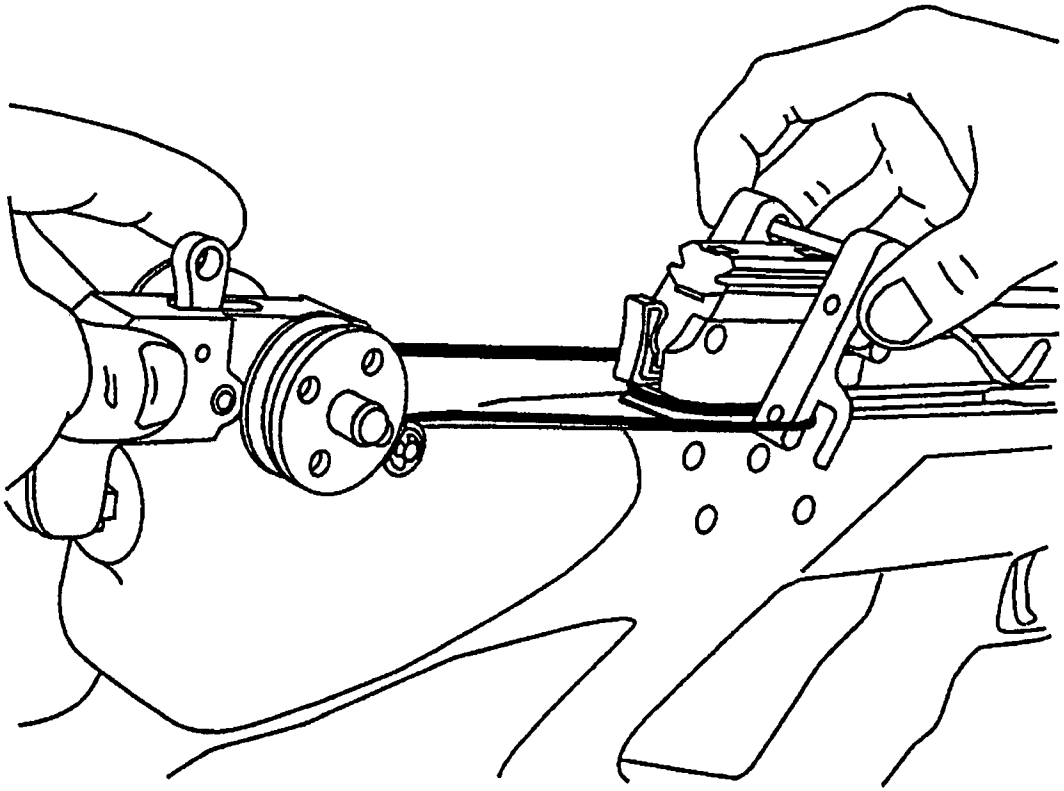
FIG. 10 is a perspective view showing one step in installing the cocking winch apparatus on a crossbow.

In another step of the method, the user forms the tensioning cable 50 in a general W shape, as shown in FIG. 1, and places the central portion 56 thereof into a slot 105 provided behind a scope mount 107 of the crossbow. This step is shown in FIG. 10 of the drawings.

Figure 11:
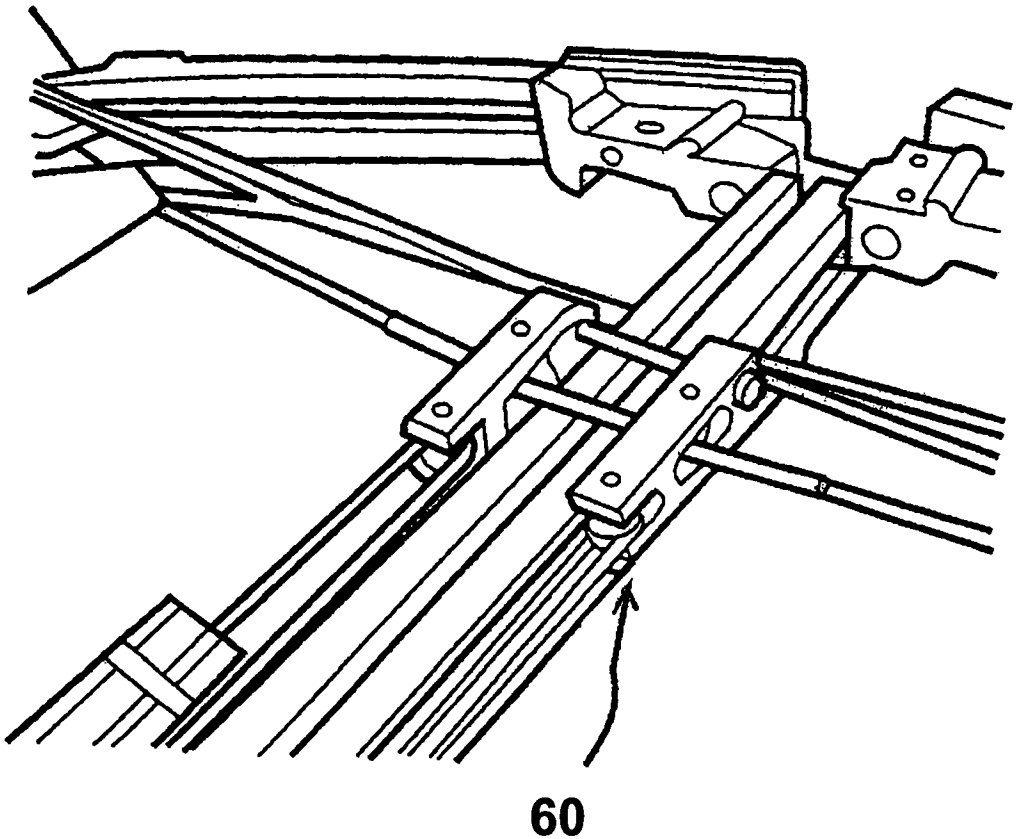
FIG. 11 is a perspective view showing another step in installing the cocking winch apparatus on a crossbow.

In the next step of the exemplary method, the user engages the bowstring hook member 60 of the cocking apparatus with the bowstring 104 of the crossbow, with the bowstring in a released position thereof. This is done by placing the hook member 60 on top of the bowstring 104, so that the bowstring fits into the slot 62 of the hook member, and is contacted by the front pulleys 66 thereof. This engaging step is shown in FIG. 11 of the drawings.

In the next step of the exemplary method, the user operates the cocking winch apparatus to draw the bowstring hook member and the engaged bowstring rearwardly towards a bowstring latch mechanism 106 contained in the scope mount 107. Then, the user engages the bowstring 104 in the bowstring latch mechanism 106. The beginning portion of this operating step is suggested by FIG. 1C.

Figure 12:
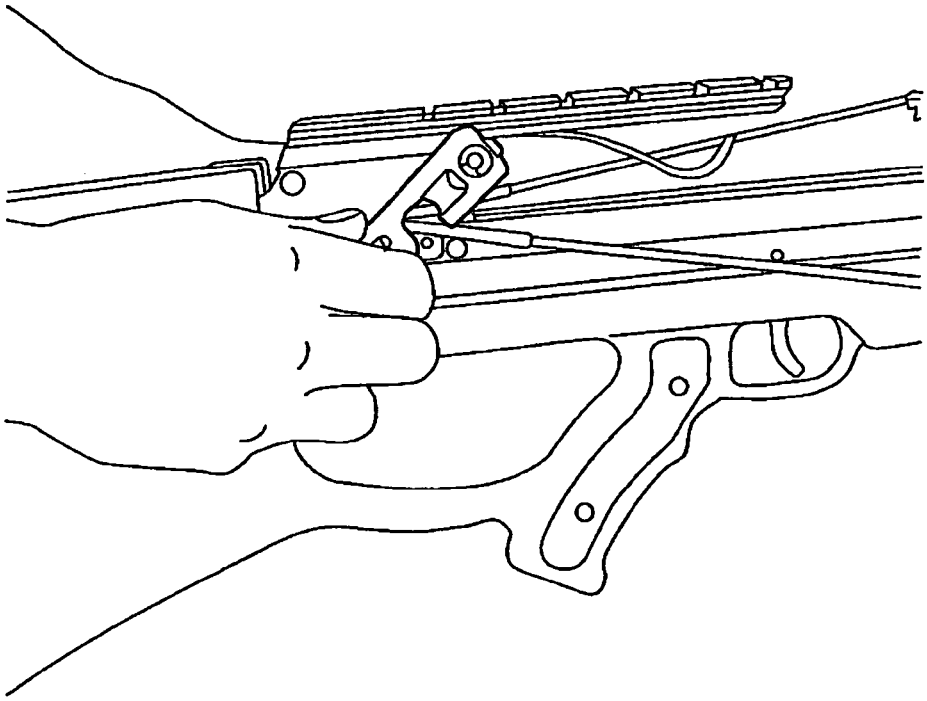
FIG. 12 is a side plan view showing the hook member being removed from the bowstring, with the bowstring latched into the crossbow's trigger latch.

Once the bowstring 104 has been locked in place in the latching mechanism 106, the cocking winch 20 can be easily removed from the crossbow 100, to de-clutter the crossbow and to make the crossbow easier to fire. This removal step is shown in FIG. 12 of the drawings.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

Having, thus, described the invention, what is claimed is:

1. A cocking winch apparatus for attaching to a crossbow and for use in cocking the crossbow, said apparatus comprising:

a winch body having an upper portion, a lower portion and a central portion interconnecting the upper and lower portions, the upper portion of the winch body having a front end, a rear end and two opposed side portions and having a hollow chamber formed therein and a cylindrical passage formed laterally therethrough between the side portions, the lower portion of the winch body comprising an alignment member projecting forwardly below the upper portion and having a non-round cross-sectional shape, wherein the winch body is removably securable to a crossbow stock by aligning the winch body with the stock and inserting the alignment member into a correspondingly-shaped hole formed in the stock;

a cylindrical support shaft extending through the cylindrical passage of the winch body;

a first take-up spool and a second take-up spool mounted on opposed end portions of the support shaft outside of the winch body;

a ratchet wheel mounted on the support shaft between the first and second take-up spools, the ratchet wheel disposed in the hollow chamber of the winch body and having a plurality of teeth formed therearound;

a pawl having a first end disposed in the hollow chamber of the winch body and pivotally attached to the winch body, and a second end opposite the first end, the pawl having a tooth formed thereon for selective engagement between adjacent teeth of the ratchet wheel;

a spring for biasing the pawl towards the ratchet wheel;

a handle member operatively attachable to one of the take-up spools, a tensioning cable having a first end attached to the first take-up spool, a second end attached to the second take-up spool, and a central portion between the first and second ends; and a bowstring hook member having a slot formed in a lower portion thereof to receive a bowstring of the crossbow, wherein the central portion of the tensioning cable passes through a portion of the bowstring hook member.

2. The cocking winch apparatus of claim 1, wherein the bowstring hook member comprises a bowstring guide assembly comprising a frame, a pair of front pulleys and a pair of rear pulleys, the respective front and rear pulleys being rotatably attached to the frame, wherein the central portion of the tensioning cable passes through a portion of the frame proximate the rear pulleys of the bowstring guide assembly.

3. The cocking winch apparatus of claim 1, wherein the alignment member has a substantially positive symbol (+)—shaped cross-sectional shape.

4. The cocking winch apparatus of claim 1, wherein the alignment member has an asymmetrical cross-sectional shape.

5. A cocking winch apparatus for attaching a crossbow and for use in cocking the crossbow, said apparatus comprising:

a winch body having an upper portion, a lower portion and a connecting portion interconnecting the upper and lower portions, the upper portion of the winch body having a front end, a rear end and two opposed side portions and having a hollow chamber formed therein and a cylindrical passage formed laterally therethrough between the side portions, the lower portion of the winch body comprising a projecting alignment member having a non-round cross-sectional shape, wherein the alignment member is removably securable to a crossbow stock by inserting the alignment member into a correspondingly-shaped hole formed in the stock;

a cylindrical support shaft extending through the cylindrical passage of the winch body;

a first take-up spool and a second take-up spool mounted on opposed end portions of the support shaft outside of the winch body;

a ratchet wheel mounted on the support shaft and disposed in the hollow chamber of the winch body;

a pawl having a first end disposed in the hollow chamber of the winch body and pivotally attached to the winch body, and a second end extending outside of the winch body, the pawl having a medial tooth formed thereon for selectively engaging between teeth of the ratchet wheel, a handle member operatively attachable to one of the take-up spools, a tensioning cable having a first end attached to the first take-up spool, a second end attached to the second take-up spool, and a central portion between the first and second ends; and a bowstring guide assembly comprising a frame, a plurality of front pulleys and a plurality of rear pulleys, the pulleys being rotatably attached to the frame, wherein the central portion of the tensioning cable passes around the rear pulleys of the bowstring guide assembly.

6. A crossbow system comprising in combination, a crossbow and a cocking winch apparatus operatively attachable to the crossbow, said crossbow comprising:

a stock having a front end and a rear end with a longitudinal axis extending therebetween, wherein the front end defines a shooting direction, the front end comprising a main beam having a horizontal slot formed therein, and the rear end having a non-round shaped hole formed therein and a channel extending from the shaped hole inwardly into the stock;

a bow comprising a first limb and a second limb, wherein the first limb and the second limb are operatively attached to the front end of the stock in a manner in which the first limb and the second limb extend outwardly away from one another in substantially opposite directions, and a main bowstring extending between the outer ends of the limbs;

and wherein said cocking winch apparatus comprises:

a winch body having an upper portion, a lower portion and a connecting portion interconnecting the upper and lower portions, the upper portion of the winch body having a front end, a rear end and two opposed side portions and having a hollow chamber formed therein and a cylindrical passage formed laterally therethrough between the side portions, the lower portion of the winch body comprising a projecting alignment member having a non-round, cross-sectional shape, wherein the alignment member is removably securable to the crossbow stock by inserting the alignment member into said non-round shaped hole in the stock;

a cylindrical support shaft extending through the cylindrical passage of the winch body, a first take-up spool and a second take-up spool mounted on opposed end portions of the support shaft outside of the winch body, a ratchet wheel mounted on the support shaft and disposed in the hollow chamber of the winch body, a pawl having a first end disposed in the hollow chamber of the winch body and pivotally attached to the winch body, and a second end extending outside of the winch body, the pawl having a medial tooth formed thereon for selectively engaging between teeth of the ratchet wheel, a handle member operatively attachable to one of the take-up spools, a tensioning cable having a first end attached to the first take-up spool, a second end attached to the second take-up spool, and a central portion between the first and second ends; and a bowstring hook member having a slot formed in a lower portion thereof to receive the bowstring, wherein the central portion of the tensioning cable passes through a portion of the bowstring hook member.

7. The crossbow system of claim 6, wherein the alignment member has a substantially positive symbol (+)—shaped cross-sectional shape.

8. The crossbow system of claim 6, wherein the alignment member has an asymmetrical cross-section.

9. The crossbow system of claim 6, wherein the bowstring hook member comprises a bowstring guide assembly comprising a frame, a pair of front pulleys and a pair of rear pulleys, the respective front and rear pulleys being rotatably attached to the frame, wherein the central portion of the tensioning cable passes through a portion of the frame proximate the rear pulleys of the bowstring guide assembly.

10. A method of cocking a crossbow, comprising the steps of:

a) providing a cocking winch apparatus which has a winch body, a bowstring hook member and a tensioning cable, the winch body having an alignment member, the bowstring hook member comprising a bowstring guide assembly comprising a frame, a pair of front pulleys and a pair of rear pulleys, the respective front and rear pulleys being rotatably attached to the frame, wherein a central portion of the tensioning cable passes through a portion of the frame proximate the rear pulleys of the bowstring guide assembly;

b) providing the crossbow which has a crossbow stock, a bowstring and a bowstring latch mechanism, the crossbow stock having a shaped opening formed therein;

(c) engaging the cocking winch apparatus with the crossbow stock by aligning the winch body with the crossbow stock and inserting the alignment member of the winch body into the shaped opening formed in the crossbow stock which is configured to accept the alignment member therein;

d) engaging the bowstring hook member with the bowstring of the crossbow, with the bowstring in a released position thereof;

(e) operating the cocking winch apparatus to draw the bowstring hook member and the engaged bowstring rearwardly towards the bowstring latch mechanism; and f) engaging the bowstring with the bowstring latch mechanism.

* * * * *